US006186481B1

(12) United States Patent
Pirkle

(10) Patent No.: US 6,186,481 B1
(45) Date of Patent: Feb. 13, 2001

(54) QUIET STEAM-WATER MIXER

(75) Inventor: Fred L. Pirkle, Abington, PA (US)

(73) Assignee: Therm-Omega-Tech, Inc., Warminster, PA (US)

( * ) Notice: Under 35 U.S.C. 154(b), the term of this patent shall be extended for 0 days.

(21) Appl. No.: 09/300,623

(22) Filed: Apr. 27, 1999

(51) Int. Cl.[7] ..... B01F 3/04
(52) U.S. Cl. ..... 261/39.1; 261/79.2; 261/DIG. 10
(58) Field of Search ..... 261/39.1, 79.2, 261/DIG. 10

(56) References Cited

U.S. PATENT DOCUMENTS

| | | | | |
|---|---|---|---|---|
| 928,665 | * | 7/1909 | Kelly | 261/DIG. 10 |
| 3,219,325 | * | 11/1965 | Brown | 261/39.1 |
| 3,844,721 | * | 10/1974 | Cariou et al. | 261/79.2 |
| 3,984,504 | * | 10/1976 | Pick | 261/DIG. 10 |
| 4,053,142 | | 10/1977 | Johannes . | |
| 4,123,800 | | 10/1978 | Mazzei . | |
| 4,371,382 | * | 2/1983 | Ross | 261/79.2 |
| 4,398,827 | * | 8/1983 | Dietrich | 261/79.2 |
| 4,464,314 | * | 8/1984 | Surovikin et al. | 261/79.2 |
| 4,474,477 | | 10/1984 | Smith et al. . | |
| 4,647,212 | | 3/1987 | Hankison . | |
| 4,773,827 | * | 9/1988 | Zaiser | 261/39.1 |
| 5,209,396 | | 5/1993 | Cooney | 236/12.14 |
| 5,816,493 | * | 10/1998 | Pirkle | 236/101 R |
| 6,082,713 | * | 7/2000 | King | 261/DIG. 10 |

* cited by examiner

*Primary Examiner*—C. Scott Bushey
(74) *Attorney, Agent, or Firm*—Howson and Howson

(57) ABSTRACT

A mixing valve receives water through a first inlet. The water is rotated by vanes in a first direction to produce a vortex. The water exits though an open end of a slidable tube, where it flows radially outward because of its rotational motion. The tube is axially movable by an actuator located near the open end of the tube, and the tube therefore acts as a steam shut off valve. Steam enters through a second inlet adjacent the open end of the tube, and is directed by vanes in an oppositely rotating vortex and radially inward by a conical surface just beyond the end of the tube. The steam and water mix at a location just beyond the end of the tube, and heated water exits through an axial opening which surrounds the actuator. The temperature of the water is regulated by the actuator.

25 Claims, 3 Drawing Sheets

QUIET STEAM-WATER MIXER

SUMMARY OF THE INVENTION

This invention relates generally to static mixing of fluids, and more particularly to an apparatus for mixing streams of water and steam and delivering a stream of heated water.

In many industrial operations, especially in chemical processes, plant steam provides a convenient source of heat, and can be mixed with water, to provide instant hot water. Conventional steam-water mixing devices, however, are subject to several problems.

One problem with conventional steam-water mixing devices is due to the rapid collapse of steam bubbles as the steam condenses upon contact with the water. The rapid collapse of steam bubbles sets up vibrations in the mixing device and in associated plumbing, producing a large amount of noise.

Another problem is that failure of the water supply to a conventional mixing device can cause it to deliver steam at its outlet unless elaborate precautions are taken to make the mixing device fail-safe.

The principal object of this invention is to provide a simple and reliable steam-water mixing device that is much quieter in operation that previously available steam-water mixers. Still another object of the invention is to provide a simple steam-water mixing device that reliably avoids dangerous maloperation in the event of a water supply failure.

Briefly, the invention addresses the noise problem by guiding the incoming water and steam into coaxial vortices inside and outside of a tube, respectively. The vortices come together just beyond an open end of the tube, and mix to produce a stream of heated water. Regulation and fail-safe operation are achieved by using the tube itself as a component of a valve. The tube is moved axially by a temperature-responsive mechanical actuator, and cooperates with a deflecting shoulder in a housing to regulate the flow of steam. The movement of the tube relative to the actuator not only regulates the temperature of the water, but also shuts off the flow of steam in the event of a failure of the water supply.

The steam and water mixing apparatus in accordance with the invention has, as one of its components, a tube extending along an axis and having an axial opening at one end. Water is directed, preferably by a first set of vanes, into the interior of the tube, to establish a first vortex of water circulating about the axis, both within the tube and beyond the axial opening. Steam is directed, preferably by a second set of vanes, in a second vortex surrounding the tube, circulating about the axis and extending beyond the end of the tube. The vortices are directed into contact with each other, preferably by a deflecting surface which reduces the radius of the steam vortex, and by an expansion space causing the water to be directed outward, so that the water and steam mix together to produce a stream of heated water.

Several other features are present in a preferred embodiment of the invention. One such feature is that the water and steam are directed into counter-rotating vortices. Other preferred features include the following.

The flow of steam is regulated in response to the temperature of the exiting heated water stream to maintain the heated water at a substantially constant temperature, and the temperature-responsive regulating mechanism also shuts off the flow of steam when the rate of flow of water falls below a predetermined minimum level. The tube and the deflecting surface are relatively movable in the direction of the axis to vary the cross-section of the steam flow passage, so that the tube and surface together serve as a steam valve. The flow of steam is controlled by a temperature-responsive actuator for effecting relative axial movement of the tube and the deflector surface in a direction to reduce the cross section of the flow passage as the temperature of the heated water increases.

The actuator is preferably a mechanical actuator comprising a body and a stem which projects from the body as the temperature of the heated water increases. The actuator body is connected to the tube through a sleeve which extends along the axis into the tube through the axial opening. The stem of the actuator bears against a rod which extends, along the axis, through the sleeve and in turn bears against a surface which is held in fixed relationship to the tubular enclosure. Thus, the actuator moves the tube axially relative to the deflector in a direction to decrease the cross-sectional area of the annular opening as the temperature of said heated water in the exiting stream increases. An adjusting screw, threaded into the tubular enclosure and extending along the axis, has an end providing the surface against which said rod bears.

Other objects, details and advantages of the invention will be apparent from the following detailed description when read in conjunction with the drawings.

DETAILED DESCRIPTION

Figure 1:
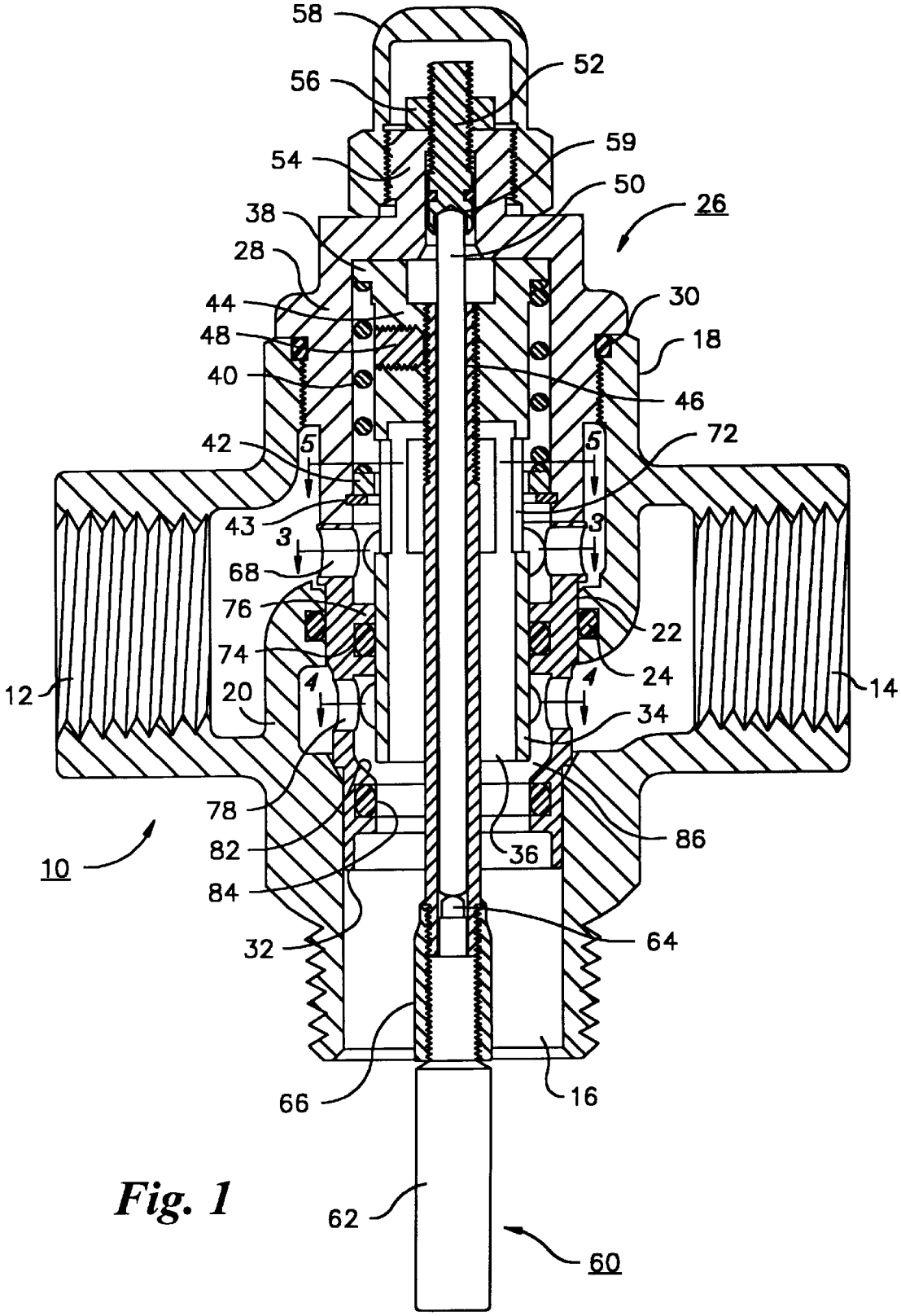
FIG. 1 is an axial cross-section of a steam-water mixing apparatus in accordance with the invention.

The steam-water mixing apparatus of the invention can be housed in a conventional valve body 10, having first, second and third ports 12, 14 and 16, and a neck 18. The valve body is cast with an internal wall 20, having a circular opening 22, which, in normal usage, would provide a mounting for a valve seat. However, in this case, the opening 22 is formed with a cylindrical inner face having a groove receiving an O-ring 24. Port 12 serves as a water inlet port, port 14 serves as a steam inlet port, and port 16 serves as a heated water outlet port.

The steam-water mixing apparatus 26 comprises a tubular enclosure 28 threaded into neck 18, and sealed in neck 18 by an O-ring 30. The apparatus 26 extends through O-ring 24 and into port 16, with a reduced end portion 32 of the apparatus closely fitting the wall of the upper part of port 16.

Within enclosure 28 is a tube 34 having an opening 36 at its lower end. The upper end of the tube 34 has a flange 38, and a coil spring 40, surrounding the tube 34, is in compression between flange 38 and a retaining ring 42, which is held in place within enclosure 28 by a snap ring 43.

The tube 34 has a closure 44 in its upper part, and a sleeve 46 is threaded into the closure and locked in place by a set screw 48. The sleeve receives a rod 50, the upper end of which engages an adjusting screw assembly including a screw 52 threaded into a neck 54 formed at the upper end of the enclosure 28, and locked in place by a locking nut 56.

The adjusting screw and locking nut are protected by a cover 58, which is threaded onto the exterior of the neck. The adjusting screw assembly includes a rod-receiving element 59, which is engaged by the upper end of the rod 50, and which has a groove with an O-ring as a seal to prevent water leakage to the vicinity of the adjusting screw.

An actuator 60, comprising an actuator body 62 and a piston 64, is connected to the lower end of the sleeve 46 by a connector 66. The actuator body 62 is threaded into the sleeve, and its piston 64 bears against the lower end of rod 50. The actuator is preferably a thermally responsive mechanical actuator of the kind described in my U.S. Pat. No. 5,816,493, dated Oct. 6, 1998, incorporating a thermally expansible material comprising an elastomer and a thermostatic wax. The disclosure of U.S. Pat. No. 5,816,493 is incorporated by reference.

Figure 2:
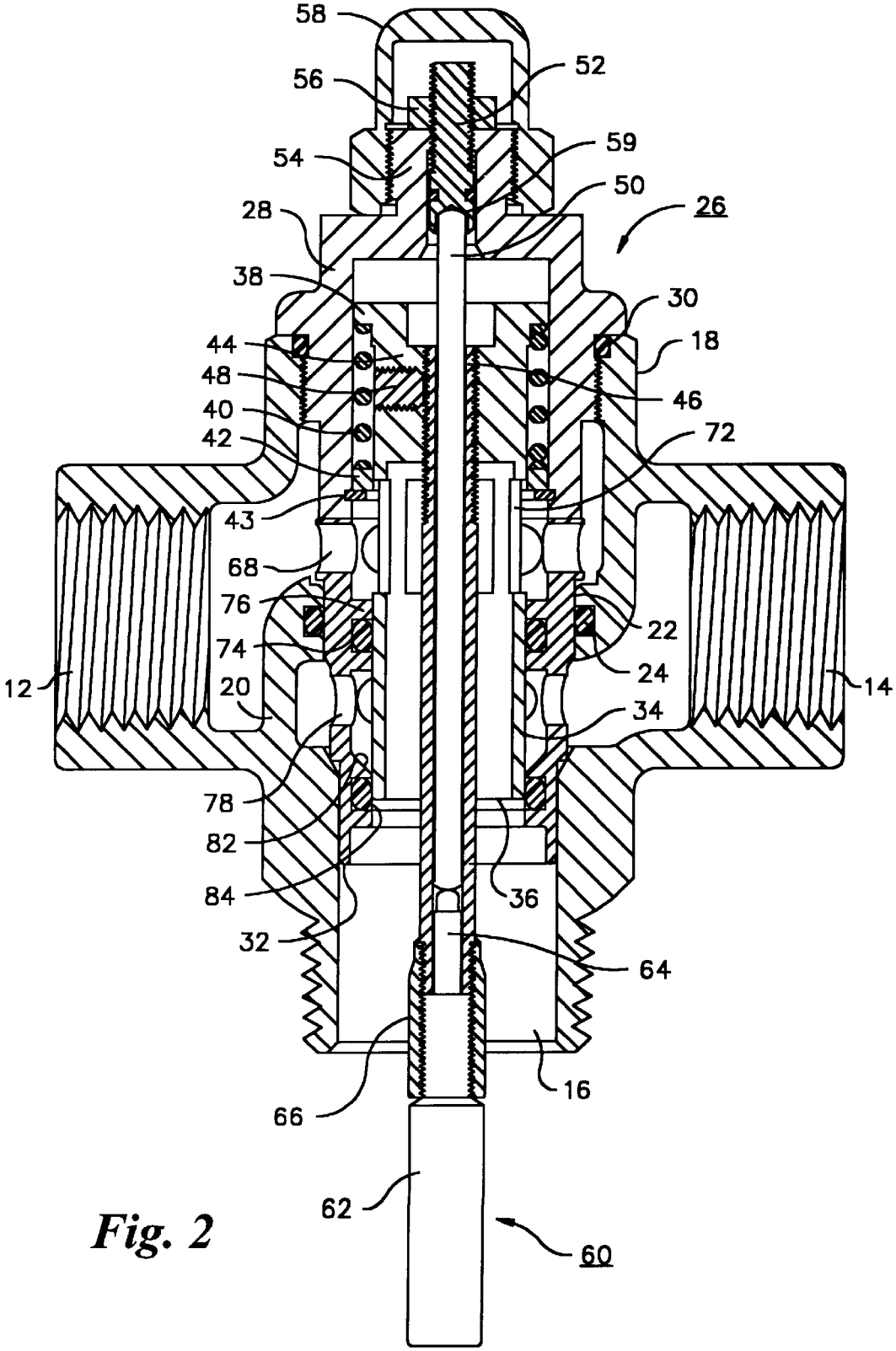
FIG. 2 is an axial cross-section of the same mixing apparatus, showing the tube extending past the steam deflector to shut off the flow of steam.

The body of the actuator, which contains the thermally expansible material, is located outside the tube 34 and aligned with opening 36. It is positioned so that it is responsive to the temperature of the stream of heated water flowing through port 16. In operation, if the temperature of the exiting water rises, the thermally responsive material will expand, causing piston 64 to extend. The force of the piston against the end of rod 50 produces a reaction by which the actuator body pulls downwardly, on sleeve 46, causing the tube 34 to move downward, as shown in FIG. 2. The downward movement of the tube 34 compresses coil spring 40.

Figure 3:
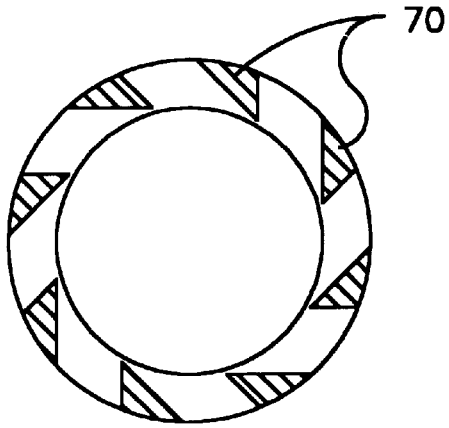
FIG. 3 is a radial section taken on plane 3—3 in FIG. 1, showing the water vanes.
Figure 5:
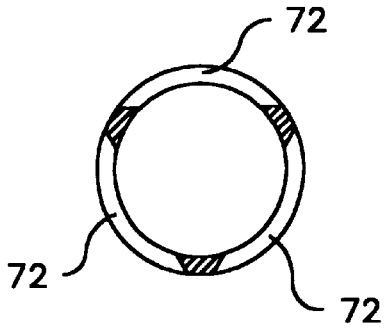
FIG. 5 is a radial section taken on plane 5—5 in FIG. 1, showing the water openings in the tube.

Water inlet port 12 communicates with the interior of the enclosure 28 through an annular vaned opening 68, having vanes 70 (FIG. 3) which are disposed to induce a clockwise vortex (looking down) in the inflowing water. The tube 34 has a set of three openings 72 (FIGS. 1 and 5), which are separated from one another by narrow partitions that do not materially affect the vortex flow of water through the openings 72. The openings are sufficiently large to allow the vortex induced by vanes 70 to continue within the tube 34 and past the opening 36 at the lower end of the tube. Openings 72 are preferably axially longer than vaned opening 68, and are positioned so that they at least partially overlap vaned opening 68 both when the tube is in its uppermost position as shown in FIG. 1, and in its lowermost position, as shown in FIG. 2. In normal operation, the tube will be in an intermediate position between the positions shown in FIGS. 1 and 2, with the lower edges of openings 72 either approximately aligned with, or below, the lower edge of vaned opening 68.

The lower part of enclosure 28, just above its end 32, and the inner wall of outlet port 16, define an expansion space that is radially larger than the opening 36 of tube 34. This expansion space allows the rotating water vortex exiting from the tube through opening 36 to expand radially, so that the water vortex is directed outward in the space below opening 36.

The tube 34 extends through a sealing ring 74 fitted in a groove in an annular barrier 76 formed on the inner wall of the enclosure 28. This barrier prevents steam and water from coming into contact with each other in the space between the tube and the inner wall of enclosure 28.

Figure 4:
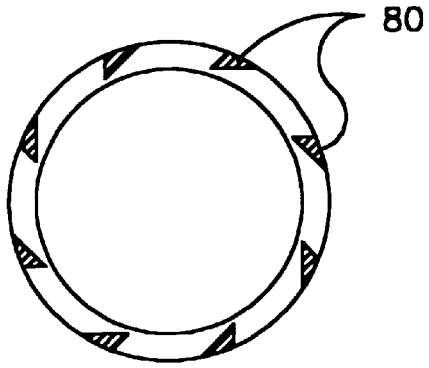
FIG. 4 is a radial section taken on plane 4—4 in FIG. 1, showing the steam vanes.

Below the location of the barrier, the enclosure 28 has another annular, vaned opening 78 in communication with the steam inlet port 14. This opening is provided with vanes 80 (FIG. 4) which induce a counterclockwise flow of steam (looking down) in the annular space surrounding the lower portion of tube 34.

A frusto-conical deflecting surface 82 is formed in the inner wall of the enclosure 28 adjacent its lower end. Below the deflecting surface, the inner wall of the enclosure has a diameter slightly larger than the outer diameter of the tube 34, and has a groove with an O-ring 84 for contacting the lower portion of tube 34 when the tube 34 moves downward.

As shown in FIG. 1, when the tube 34 is in its uppermost position, and also during normal operation, there is an annular gap 86 between the lower end of the tube and the frusto-conical deflecting surface for the flow of steam downward and inward toward the water flowing out of the lower end of tube 34. The clockwise rotation in the water vortex forces the water outward, while the deflecting surface 82 deflects the counterclockwise rotating steam vortex inward, so that the steam and water meet just below the opening 36 at the lower end of the tube 34. The counter-rotating vortices of steam and water mix in the space just below the lower end of the tube and above the actuator body 62, producing a stream of heated water, which flows downward through port 16.

In operation of the mixer, the actuator, responding to the temperature of the exiting water stream, regulates the position of the tube 34 to control the size of gap 86 and thereby control the flow of steam through the steam port 14 and through the vaned opening 78. This holds the temperature of the exiting water stream at a constant level determined by the thermal characteristics of the actuator.

Setting screw 52 controls the initial position of tube 34, and is used to adjust the starting size of gap 86.

Although I do not intend to be bound by any particular theory of operation, I have found that the high noise reduction achieved by the invention is apparently the result of the collision of the steam and water streams by virtue of the inward deflection of the rotating stream of steam by surface 82 and the tendency of the rotating stream of water to move radially outward is it passes beyond the opening of tube 34. If water is passed into the device through port 14 and steam is passed into the device through port 12, no similar noise reduction performance occurs. The collision of the steam and water streams eliminates the noise that occurs as the result of collapsing steam bubbles in conventional mixers in which steam is injected into cold water. In the preferred embodiment, the inwardly directed steam vortex collides with an outwardly moving water vortex in the space below the opening 36 of tube 34. However, it is also possible to achieve noise reduction in an embodiment in which the steam vortex is deflected inward while the water vortex is confined so that it does not expand radially, and in an embodiment in which the water vortex is permitted to expand radially and the steam vortex is not deflected inward. The terminology "means for directing the vortices into contact with each other," as used herein, should therefore be understood as encompassing the steam deflection surface 82, or the expansion space below opening 36 of tube 34, or both, or any equivalent directing means capable of causing inward radial movement of the steam vortex, outward radial movement of the water vortex, or both, whether specifically mentioned herein or within the level of ordinary skill in the art.

As mentioned previously, the steam and water vortices preferably counter-rotate. Counter-rotation makes relatively little difference at high flow rates, and it is possible to achieve good noise reduction with the steam and water streams rotating in the same direction. However, at lower flow rates noise reduction is considerably better with counter-rotating steam and water vortices.

In the event of a failure of the water supply, the presence of steam in the vicinity of the actuator body will raise the temperature of the actuator to a level such that it moves the tube 34 to the closed position depicted in FIG. 2, rapidly shutting off the flow of steam. In general, the hot water delivery piping connected to outlet port 16 will be sufficiently long that any steam that flows through gap 86 before it is closed by tube 34 will have condensed within the piping.

With the flow of steam shut off, the actuator causes the valve to operate as a trap. That is, as the actuator 60 cools, it causes the gap 86 to open slightly, slowly discharging condensate, which accumulates in the steam supply side of the device. The warm condensate, in turn, contacts the actuator body 62, causing a modulating action, keeping the gap nearly closed. Any steam which escapes through the gap once again causes the gap to close fully until the actuator cools and the modulating action resumes. The gap will not open fully until the water supply is restored.

Various modifications can be made to the apparatus described. For example, the thermally responsive actuator can be any of a wide variety of devices, for example a thermostat actuator utilizing a wax pellet, or a positioning motor controlled by an external, temperature-responsive controller such as a PID (proportional integral derivative) controller or PLC (programmed logic controller).

Various departures can be taken from the specific structure shown in the drawings. For example, the water vortex can be generated by vanes mounted in tube 34 instead of by vanes mounted in passage 68 of enclosure 28. Likewise, the steam vortex can be produced by vanes mounted on the exterior of the tube instead of by vanes mounted in opening 78. The steam and water vortices can also be produced by any of a wide variety of known alternative vortex-producing devices such as deflectors, tangential flow nozzles, spiral inserts, rotating impellers and the like. Thus, the terminology "means for directing water into the interior of the tube and for establishing a first vortex of water" should be understood as encompassing not only a vaned passage external to the tube 34, but also alternatives such as a simple water conduit external to the tube together with a vortex producing device, such as a spiral insert, within, on or external to, the tube.

The configuration of parts at the location of the open end of tube 34 can also be modified. For example, the lower end of tube 34 can be externally tapered, and can cooperate with a horizontal shoulder rather than with frusto-conical deflecting surface 82.

The setting screw 52 can be replaced by an external positioning motor that is modulated by a PID or PLC temperature controller. The controller can be set for any temperature by a thermocouple or a downstream sensor. The actuator 62 can then act as a safety device, setting an upper limit on the discharge temperature.

Still other modifications may be made to the apparatus and method described above without departing from the scope of the invention as defined in the following claims.

What is claimed is:

1. Apparatus for mixing steam and water and delivering a stream of heated water, comprising:

a tube extending along an axis and having an axial opening at one end;

means for directing water into the interior of the tube and for establishing a first vortex of water circulating about said axis, both within the tube and beyond the axial opening;

means for directing steam in a second vortex surrounding the tube, circulating about said axis and extending beyond said one end of the tube;

means for directing the vortices into contact with each other, whereby the water and steam mix together to produce a stream of heated water, and means, responsive to the temperature of the heated water in said stream, for regulating the flow of steam through said directing means, and maintaining the heated water at a substantially constant temperature.

2. Apparatus for mixing steam and water and delivering a stream of heated water, comprising:

a tube extending along an axis and having an axial opening at one end;

means for directing water into the interior of the tube and for establishing a first vortex of water circulating about said axis, both within the tube and beyond the axial opening;

means for directing steam in a second vortex surrounding the tube, circulating about said axis and extending beyond said one end of the tube;

means for directing the vortices into contact with each other, whereby the water and steam mix together to produce a stream of heated water, and means, responsive to the temperature of the heated water in said stream, for shutting off the flow of steam through said directing means when the rate of flow of water falls below a predetermined minimum level.

3. Apparatus according to claim 1, wherein said means, responsive to the temperature of the heated water in said stream, for regulating the flow of steam through said directing means, and maintaining the heated water at a substantially constant temperature also shuts off the flow of steam through said directing means when the rate of flow of water falls below a predetermined minimum level.

4. Apparatus for mixing steam and water and delivering a stream of heated water, comprising:

a tube extending along an axis and having an axial opening at one end;

means for directing water into the interior of the tube and for establishing a first vortex of water circulating about said axis, both within the tube and beyond the axial opening;

means for directing steam in a second vortex surrounding the tube, circulating about said axis and extending beyond said one end of the tube;

means for directing the vortices into contact with each other, whereby the water and steam mix together to produce a stream of heated water, and means, responsive to the temperature of the heated water in said stream, for controlling the flow of steam through said means for directing steam, in which the means for directing the vortices into contact with each other comprises a surface located adjacent the axial opening at said one end of the tube and normally spaced from said one end of the tube to provide a steam flow passage allowing steam to flow inwardly toward said axis and mix with water exiting from said one end of the tube, in which the tube and surface are relatively movable in the direction of the axis to vary the cross-section of the steam flow passage, whereby the tube and surface together serve as a steam valve, and in which the means for controlling the flow of steam through said means for directing steam comprises a temperature-responsive actuator for effecting relative axial movement of the tube and the surface in a direction to reduce the cross section of the flow passage as the temperature of the heated water increases.

5. Apparatus for mixing steam and water and delivering a stream of heated water, comprising:

a tube extending along an axis and having an axial opening at one end;

means for directing water into the interior of the tube and for establishing a first vortex of water circulating about said axis, both within the tube and beyond the axial opening;

means for directing steam in a second vortex surrounding the tube, circulating about said axis and extending beyond said one end of the tube; and means for directing the vortices into contact with each other, whereby the water and steam mix together to produce a stream of heated water, in which the means for directing the vortices into contact with each other comprises means for reducing the radius of the second vortex as it passes said one end of the tube.

6. Apparatus for mixing steam and water and delivering a stream of heated water, comprising:

a tube extending along an axis, the tube having an axial opening at one end;

a first set of vanes, at a location remote from said axial opening, for directing water into the interior of the tube in a path circulating about the axis, to establish a first vortex of water both within the tube and beyond the axial opening;

a wall surrounding at least a part of the tube adjacent said one end and forming an annular space having an annular opening adjacent the axial opening of the tube;

a second set of vanes in the wall for directing steam into the annular space in a path circulating about the axis to establish a second vortex of steam both within the annular space and beyond the annular opening; and a deflector adjacent the axial opening at said one end of the tube, reducing the radius of the second vortex as it passes out of the annular space and beyond the annular opening, whereby steam in the second vortex is directed into contact with the water in the first vortex passing through the axial opening at said one end of the tube.

7. Apparatus according to claim 6, in which the vanes of the first set are disposed to direct water into a path circulating about the axis in a first direction, and the vanes of the second set are disposed to direct steam into a path circulating about the axis in a direction opposite to the first direction, whereby the vortices counter-rotate.

8. Apparatus according to claim 6, in which the deflector and said end of the tube together establish said annular opening, and including a temperature-responsive actuator, located outside the tube and aligned with said axial opening whereby it is responsive to the temperature of the heated water in said stream, the actuator being connected to the tube and arranged to move the tube axially relative to the deflector in a direction to decrease the cross-sectional area of the annular opening as the temperature of said heated water in said stream increases, for regulating the flow of steam through said annular opening and maintaining the heated water at a substantially constant temperature.

9. Apparatus according to claim 6, in which the deflector and said end of the tube together establish said annular opening, and including a temperature-responsive actuator, located outside the tube and aligned with said axial opening whereby it is responsive to the temperature of the heated water in said stream, the actuator being connected to the tube and arranged to move the tube axially relative to the deflector in a direction to decrease the cross-sectional area of the annular opening as the temperature of said heated water in said stream increases, the actuator being arranged to move the tube sufficiently to shut off the flow of steam through said annular opening when the rate of flow of water falls below a predetermined minimum level.

10. Apparatus according to claim 6, in which the deflector and said end of the tube together establish said annular opening, and including a temperature-responsive actuator, located outside the tube and aligned with said axial opening whereby it is responsive to the temperature of the heated water in said stream, the actuator being connected to the tube and arranged to move the tube axially relative to the deflector in a direction to decrease the cross-sectional area of the annular opening as the temperature of said heated water in said stream increases, for regulating the flow of steam through said annular opening and maintaining the heated water at a substantially constant temperature and the actuator being arranged to move the tube sufficiently to shut off the flow of steam through said annular opening when the rate of flow of water falls below a predetermined minimum level.

11. Apparatus according to claim 6, in which the first set of vanes for directing water into the interior of the tube is connected to a water supply, and in which the second set of vanes for directing steam into the annular space is connected to a steam supply.

12. Apparatus for mixing steam and water and delivering a stream of heated water, comprising:

a tubular enclosure extending along an axis, surrounded at a first axial location by a water manifold connectible to a water supply, and having a first set of vanes for deflecting water entering the tubular enclosure from the water manifold into a first vortex circulating about said axis, and surrounded at a second axial location by a steam manifold connectible to a steam supply, and having a second set of vanes for deflecting steam entering the tubular enclosure from the steam manifold into a second vortex also circulating about said axis;

a tube extending axially within the tubular enclosure, the tube having an axial opening at one end, and having radial openings adjacent the first set of vanes for passage of water from the water manifold into the interior of the tube, the openings being sufficiently large to maintain the first vortex within the tube and beyond the axial opening at said one end of the tube;

a barrier, between the axial locations of the first and second sets of vanes, preventing direct contact of steam and water between the tubular enclosure and the tube; and a deflector adjacent the axial opening at said one end of the tube, the tube being spaced from the tubular enclosure at least from the location of the barrier to the deflector;

the deflector comprising a shoulder in the tubular enclosure, reducing the radius of the second vortex as it passes from the space between the tube and the tubular enclosure beyond said one end of the tube, whereby the steam in the second vortex is directed into contact with the water in the first vortex passing through the axial opening at said one end of the tube.

13. Apparatus according to claim 12, in which the vanes of the first set are disposed to direct water into a path circulating about the axis in a first direction, and the vanes of the second set are disposed to direct steam into a path circulating about the axis in a direction opposite to the first direction, whereby the vortices counter-rotate.

14. Apparatus according to claim 12, in which the deflector and said end of the tube together establish an annular opening through which steam passes out of the space between the tube and the tubular enclosure and into contact with the water, and including a temperature-responsive actuator, located outside the tube and aligned with said axial opening whereby it is responsive to the temperature of the heated water in said stream, the actuator being connected to the tube and arranged to move the tube axially relative to the deflector in a direction to decrease the cross-sectional area of the annular opening as the temperature of said heated water in said stream increases, for regulating the flow of steam through said annular opening and maintaining the heated water at a substantially constant temperature.

15. Apparatus according to claim 12, in which the deflector and said end of the tube together establish an annular opening through which steam passes out of the space between the tube and the tubular enclosure and into contact with the water, and including a temperature-responsive actuator, located outside the tube and aligned with said axial opening whereby it is responsive to the temperature of the heated water in said stream, the actuator being connected to the tube and arranged to move the tube axially relative to the deflector in a direction to decrease the cross-sectional area of the annular opening as the temperature of said heated water in said stream increases, the actuator being arranged to move the tube sufficiently to shut off the flow of steam through said annular opening when the rate of flow of water falls below a predetermined minimum level.

16. Apparatus according to claim 13, in which the deflector and said end of the tube together establish an annular opening through which steam passes out of the space between the tube and the tubular enclosure and into contact with the water, and including a temperature-responsive actuator, located outside the tube and aligned with said axial opening whereby it is responsive to the temperature of the heated water in said stream, the actuator being connected to the tube and arranged to move the tube axially relative to the deflector in a direction to decrease the cross-sectional area of the annular opening as the temperature of said heated water in said stream increases, for regulating the flow of steam through said annular opening and maintaining the heated water at a substantially constant temperature and the actuator being arranged to move the tube sufficiently to shut off the flow of steam through said annular opening when the rate of flow of water falls below a predetermined minimum level.

17. Apparatus according to claim 12, in which the deflector and said end of the tube together establish an annular opening through which steam passes out of the space between the tube and the tubular enclosure and into contact with the water, and including a temperature-responsive actuator, located outside the tube and aligned with said axial opening whereby it is responsive to the temperature of the heated water in said stream, the actuator comprising a body and a stem which projects from said body as the temperature of said heated water increases, the actuator body being connected to the tube through a sleeve which extends along said axis into the tube through said axial opening, and the stem of the actuator bearing against a rod which extends, along said axis, through the sleeve and in turn bears against a surface which is held in fixed relationship to the tubular enclosure, whereby the actuator moves the tube axially relative to the deflector in a direction to decrease the cross-sectional area of the annular opening as the temperature of said heated water in said stream increases.

18. Apparatus according to claim 17, including an adjusting screw threaded into the tubular enclosure and extending along said axis, the adjusting screw having an end providing said surface, held in fixed relationship to the tubular enclosure, against which said rod bears.

19. Apparatus according to claim 15, in which the first set of vanes for directing water into the interior of the tube is connected to a water supply, and in which the second set of vanes for directing steam into the annular space is connected to a steam supply.

20. A method for mixing steam and water and delivering a stream of heated water, comprising:

directing water into the interior of a tube extending along an axis and having an axial opening at one end so that the water circulates in a path about said axis, to establish a first vortex of water both within the tube and beyond the axial opening;

directing steam in a second vortex surrounding the tube, circulating about said axis and extending beyond said one end of the tube; and directing the vortices into contact with each other, whereby the water and steam mix together to produce a stream of heated water.

21. The method according to claim 20, wherein the water and steam are directed so that the first and second vortices counter-rotate about said axis.

22. The method according to claim 20, wherein the vortices are directed into contact with each other by deflecting the steam vortex radially inward.

23. The method according to claim 20, wherein the flow of steam is regulated in response to the temperature of the stream of heated water so that the flow of steam is reduced as the temperature of the heated water increases and increased as the temperature of the heated water decreases, whereby the heated water is maintained at a substantially constant temperature.

24. The method according to claim 20, including the step of shutting off the flow of steam, and thereby preventing the vortices from coming into contact with each other, when the rate of flow of water in the first vortex falls below a predetermined minimum level.

25. The method according to claim 24, wherein the rate of flow of water in the first vortex is sensed by measuring the temperature of the stream of heated water, and wherein the flow of steam is shut off in response to a rise in the measured temperature of said stream.

* * * * *

UNITED STATES PATENT AND TRADEMARK OFFICE

CERTIFICATE OF CORRECTION

PATENT NO. : 6,186,481 B1
DATED : February 13, 2001
INVENTOR(S) : Fred L. Pirkle It is certified that error appears in the above-identified patent and that said Letters Patent is hereby corrected as shown below:

Column 9,
Line 30, "claim 13" should read -- claim 12 --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*